US008360719B2

(12) United States Patent
Huang et al.

(10) Patent No.: US 8,360,719 B2
(45) Date of Patent: Jan. 29, 2013

(54) FAN

(75) Inventors: Jing-Cao Huang, Taoyuan Hsien (TW); Chui Chu, Taoyuan Hsien (TW); Yi-Liang Gong, Taoyuan Hsien (TW); Chi-Ming Yu, Taoyuan Hsien (TW)

(73) Assignee: Delta Electronics, Inc., Taoyuan Shien (TW)

( * ) Notice: Subject to any disclaimer, the term of this patent is extended or adjusted under 35 U.S.C. 154(b) by 642 days.

(21) Appl. No.: 12/578,891

(22) Filed: Oct. 14, 2009

(65) Prior Publication Data

US 2010/0183437 A1 Jul. 22, 2010

Related U.S. Application Data

(63) Continuation-in-part of application No. 12/355,335, filed on Jan. 16, 2009, now Pat. No. 8,043,064.

(30) Foreign Application Priority Data

Jun. 9, 2009 (TW) ..... 98210185 U

(51) Int. Cl.
*F04D 29/52* (2006.01)
*F04D 29/38* (2006.01)

(52) U.S. Cl. ..... 415/208.1; 415/211.1; 415/213.1; 415/214.1; 415/220; 416/189; 416/239; 416/223 R

(58) Field of Classification Search ..... 415/208.1, 415/211.2, 213.1, 214.1, 220; 416/189, 239, 416/223 R See application file for complete search history.

(56) References Cited

U.S. PATENT DOCUMENTS

| | | | | |
|---|---|---|---|---|
| 4,055,113 | A * | 10/1977 | Monroe | 454/348 |
| 5,879,141 | A * | 3/1999 | Yokozawa et al. | 417/423.7 |
| 6,544,010 | B1 * | 4/2003 | Choi | 417/423.1 |
| 6,547,540 | B1 * | 4/2003 | Horng et al. | 417/423.14 |
| 6,585,485 | B2 * | 7/2003 | Lee et al. | 415/203 |
| 6,688,848 | B2 * | 2/2004 | Ohtsuka | 416/189 |
| 7,442,010 | B2 * | 10/2008 | Gruber et al. | 416/169 A |
| 2007/0003419 | A1 * | 1/2007 | Wu et al. | 417/363 |
| 2007/0286726 | A1 * | 12/2007 | Yabuuchi | 415/220 |
| 2009/0035149 | A1 * | 2/2009 | Sun et al. | 416/244 R |

* cited by examiner

*Primary Examiner* — Igor Kershteyn

(74) *Attorney, Agent, or Firm* — Muncy, Geissler, Olds & Lowe, PLLC

(57) ABSTRACT

A fan includes an impeller comprising a hub and a plurality of blades, and a housing receiving the impeller and comprising a first frame having a side wall and an inlet, and a second frame having a side wall and an outlet, wherein an inner surface on a periphery of the inlet is a smooth curved surface. The first or second frame has at least one side hole disposed at the side wall of the first or second frame.

17 Claims, 11 Drawing Sheets

FAN

CROSS REFERENCE TO RELATED APPLICATIONS

The present invention is a continuation-in-part application of the parent application bearing Ser. No. 12/355,335 and filed on Jan. 16, 2009 now U.S. Pat. No. 8,043,064. This Non-provisional application also claims priority under 35 U.S.C. §119(a) on Patent Application No(s). 098210185 filed in Taiwan, Republic of China on Jun. 9, 2009, the entire contents of which are hereby incorporated by reference.

BACKGROUND OF THE INVENTION

1. Field of Invention

The present invention relates to a fan and, in particular, to a fan capable of increasing the airflow rate and volume, reducing the noise and increasing heat-dissipating efficiency.

2. Related Art

As a result of the advancement in process technologies, circuit boards of many electronic products are now made to carry electronic components (e.g., central processing units, memories, integrated circuits and the like) at an ever-higher density. Because electronic components generate heat during operation, denser electronic components increases the temperature of the whole electronic product, which may cause abnormal operation of the electronic products or even damage to the electronic components thereof due to intense heat.

In the prior art, a fan is disposed in an electronic product so that air flow produced by the rotating fan can force convection to cool the electronic components thereof.

FIG. 1 illustrates a conventional fan 1 including a fan wheel 11 and a fan cowl 12. The fan wheel 11 comprises a hub 110 and a plurality of blades 111. Each of the blades 111 has a blade width W1 and extends from a side wall of the hub 110.

The conventional fan 1 has a narrower blade width W1. In order to maintain certain efficiency in producing the air flow, a large number of blades must be provided. For instance, the conventional fan 1 depicted in FIG. 1 has seven blades 111. As a result, the pitch between the blades 111 is inevitably reduced. Moreover, to get a strengthened flow rate and improved heat dissipation efficiency, the rotation speed of the fan wheel 11 must be increased. However, when the fan 1 operates at a high rotation speed, there is too small of a pitch between the blades which will cause disturbance to the air flow fields produced by the blades to each other or even cause annoying noise.

According to the above description, the conventional fan 1 increases the rotational speed of the fan wheel 11 at the cost of exacerbated noise. On the other hand, if the rotational speed of the fan wheel 11 is not increased, the flow rate would be too small, which would be inadequate to deliver the desired heat dissipation efficiency for the dense electronic components.

Further, since the performance of the electronic product has been sufficiently enhanced, the heat-dissipating device or system becomes one of the indispensable components thereof. If the heat generated by the electronic product can not be dissipated properly, the performance of the electronic product may be lowered and, even more, the electronic product may be damaged. The heat-dissipating device is more important to the micro-electronic components (e.g. an integrated circuit, IC). This is because the surface of the IC continuously reduced due to the increasing integration and progressive package technology, which results in larger accumulated heat energy per unit area.

In order to enhance the heat-dissipating efficiency, it is necessary to increase the number of blades. However, in practice, it is impossible to unlimitedly increase the number of blades because the impeller will be burdened with very high pressure in high rotation speed and the space is limited, which may cause the break of the blades, generate noise or cause the airflow turbulence. In addition, in the high speed rotation, the structure of the motor and the bearing have very large load, which may decrease the lifetime of the mechanism. Besides, the side walls of the fan frame totally closed, and the periphery of the inlet of the conventional fan has an oblique design. That is the periphery is inclined downwardly from the outside to the inside. When the impeller is in stall speed, the heat-dissipating efficiency is decreased and the noise wave is highly increased.

SUMMARY OF THE INVENTION

One object of the present invention is to provide a fan capable of increasing the airflow volume and rate, reducing the noise and increasing heat-dissipating efficiency.

Another object of the present invention is to provide a fan that can keep the noise wave and the performance of the fan as the impeller is in the stall speed.

To achieve the above-mentioned objects, the present invention discloses a fan including an impeller comprising a hub and a plurality of blades, wherein each of the blades has a tip and a tail, wherein one of the blades is bent from the tip toward the tail and gradually broadened from the tip to the tail; and a housing for receiving the impeller.

Preferably, a portion of each of the blades extending beyond a bottom of the hub along an axial direction of the hub has a dimension ranged between zero and one third of the axial length of the hub. A portion of each of the blades extends beyond a top of the hub along an axial direction of the hub has a dimension ranged between one third and two thirds of an axial length of the hub. The portion of each of the blades extending beyond a top of the hub along an axial direction of the hub is larger than the portion of the blade below the top of the hub.

The hub has a central portion, a side wall disposed around the central portion, and a connection portion, wherein the connection portion is rounded and connects the central portion with the side wall, and the hub has a plurality of reinforcing ribs disposed on an inner surface thereof to reinforce the strength of the impeller.

Preferably, the tips of the blades are curved, and each of the blades has at least one portion of its periphery rounded to reduce the air disturbance around the blades.

Preferably, the tips of the blades extend upwards beyond a top surface of the housing or the tails of the blades downwards beyond a bottom surface of the housing along the axial direction of the fan.

Preferably, the housing has a top surface, a flow conducting portion, a central hole, and a receiving space, wherein the flow conducting portion of the housing is rounded to extend downwards from the top surface to the central hole.

In addition, the housing further includes a plurality of flow conducting grooves pneumatically communicating with the receiving space to guide the air flow.

The housing includes a first frame and a second frame, and a motor base, wherein the first frame has a side wall, and an inlet disposed at the center of the first frame, and the second frame includes a side wall and an outlet disposed at the center of the second frame. The first frame further includes hollow portions disposed at corners of the first frame, respectively.

Further, the first or second frame includes at least one side hole disposed at the side wall, respectively.

Preferably, the first frame further includes at least one first connecting member and at least one first screw hole, and the second frame further includes at least one second connecting member and at least one second screw hole, wherein the second connecting member has a hook to be engaged with a hole of the first connecting member when the first frame and the second frame are assembled together.

To achieve the above-mentioned objects, the present invention also discloses a fan including an impeller having a hub and a plurality of blades; and a housing receiving the impeller and including a first frame having a side wall and an inlet, and a second frame having a side wall and an outlet, wherein an inner surface on a periphery of the inlet is a smooth curved surface.

Preferably, the first frame includes a first recess disposed at the center of a bottom edge of the side wall of the first frame, the second frame includes a second recess disposed at the center of a top edge of the side wall of the second frame, and a side hole is formed by combining the first recess and the second recess.

The housing further includes a motor base disposed at the outlet, connected to the second frame through a plurality of ribs, and having a plurality of reinforcing bars within an inner side thereof.

As mentioned above, the housing of the present invention has the side holes disposed at the side walls thereof and the hollow portion disposed at the first frame so that the air input as well as the air output through the outlet can be increased, thereby enhancing the heat-dissipating efficiency of the fan.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
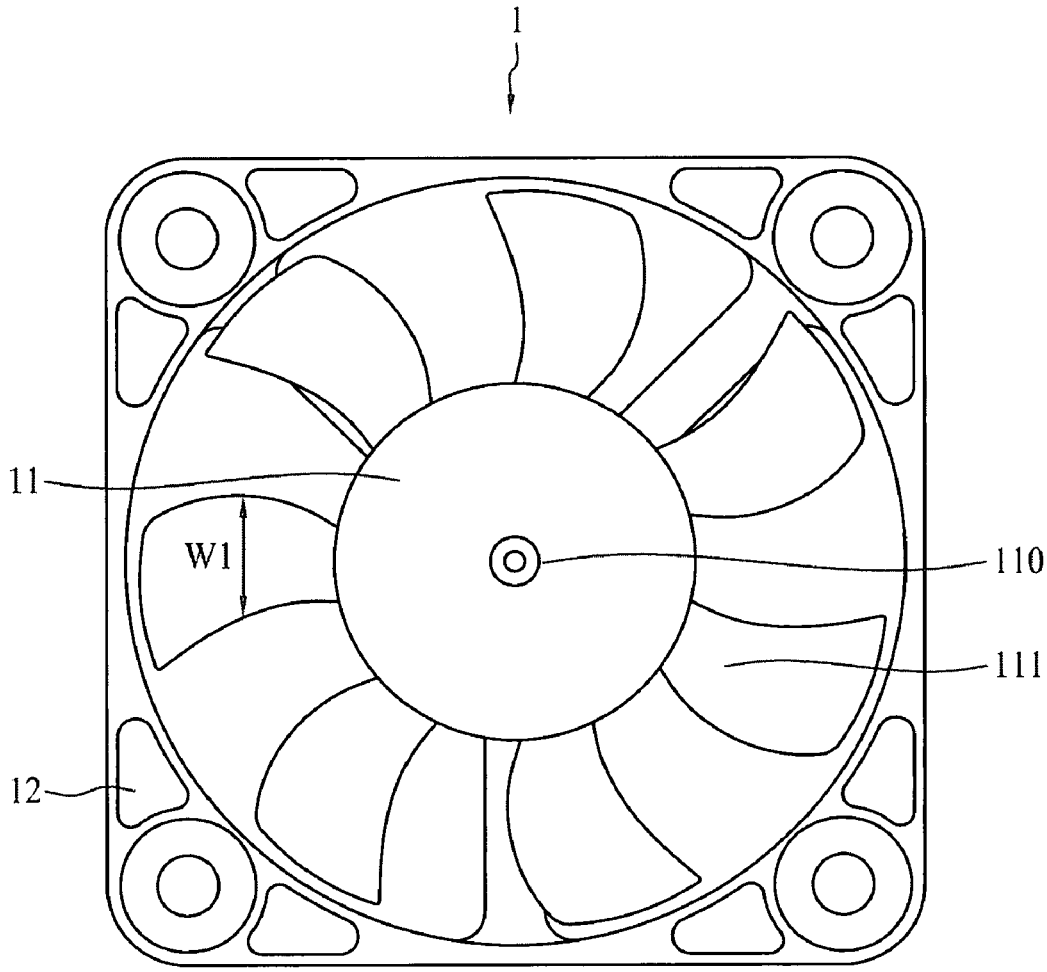
FIG. 1 (Prior Art)
FIG. 1 is a schematic diagram of a conventional fan.
Figure 2A:
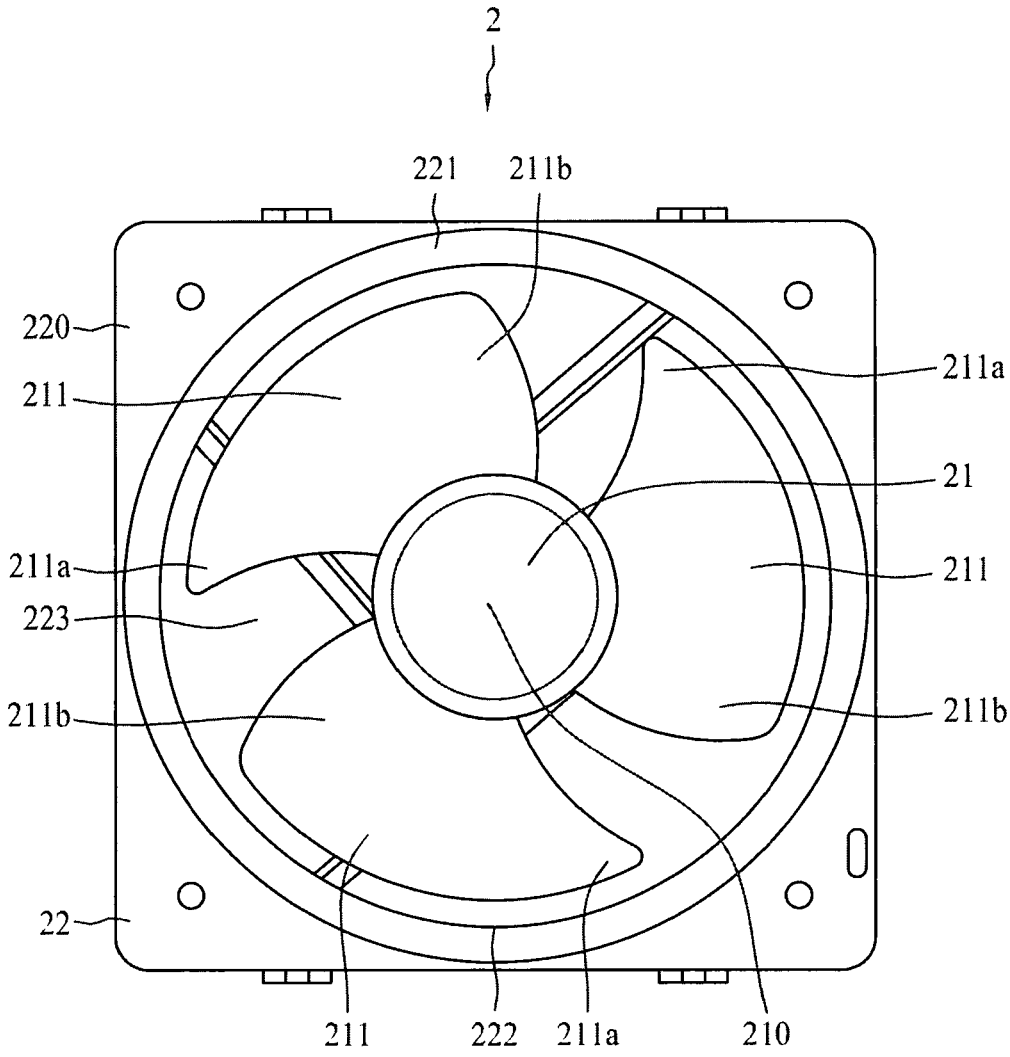
FIG. 2A is a top view of a fan according to an embodiment of the present invention.
Figure 2B:
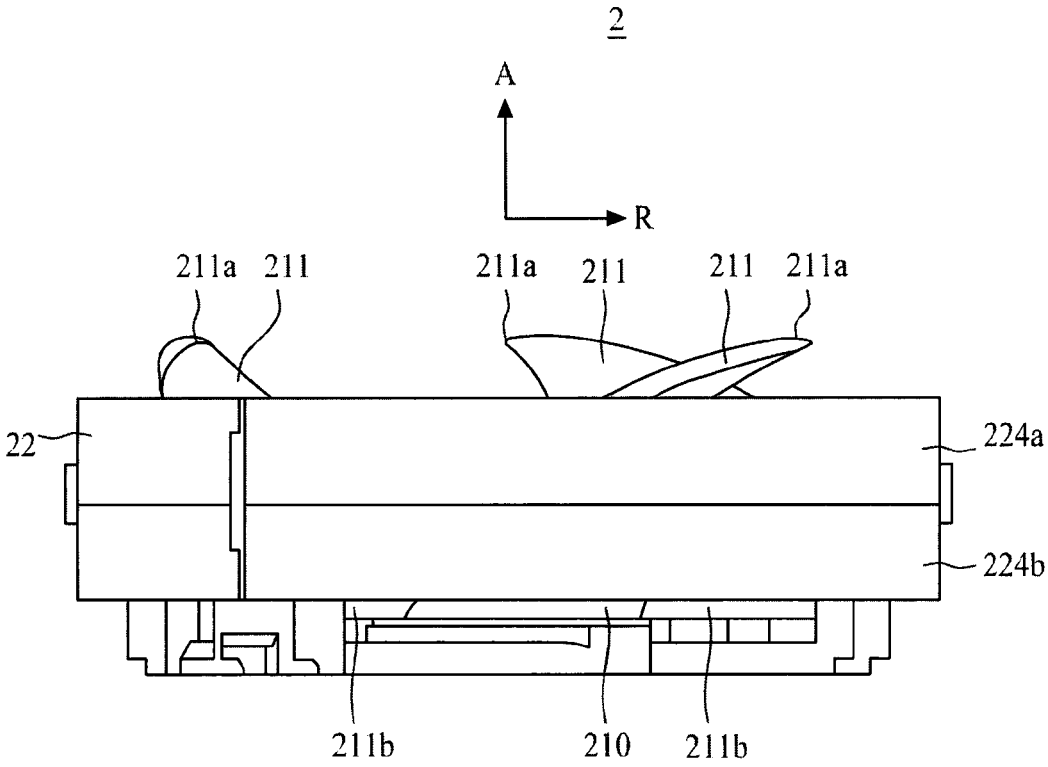
FIG. 2B is a side view of the fan shown in FIG. 2A.

FIGS. 2A and 2B illustrate the top view and the side view of a fan 2 according to this invention respectively therein. The fan 2 includes an impeller 21 and a housing 22. The housing 22 is adapted to receive the impeller 21 and guide the air flow.

The impeller 21 includes a hub 210 and a plurality of blades 211. The hub 210 defines an axial direction A and a radial direction R. Each of the blades 211 has a tip 211*a* and a tail 211*b*. The hub 210 and the blades 211 are formed as a single piece to facilitate the production. As shown in FIG. 2B, the portion of each blade 211 extending beyond the housing 22 along the axial direction A can increase the flow rate of the fan 2, thereby preventing a high rotational speed and reduce the resulting noise. The structures of the impeller 21 and the housing 22 will be detailed herein below.

Figure 3A:
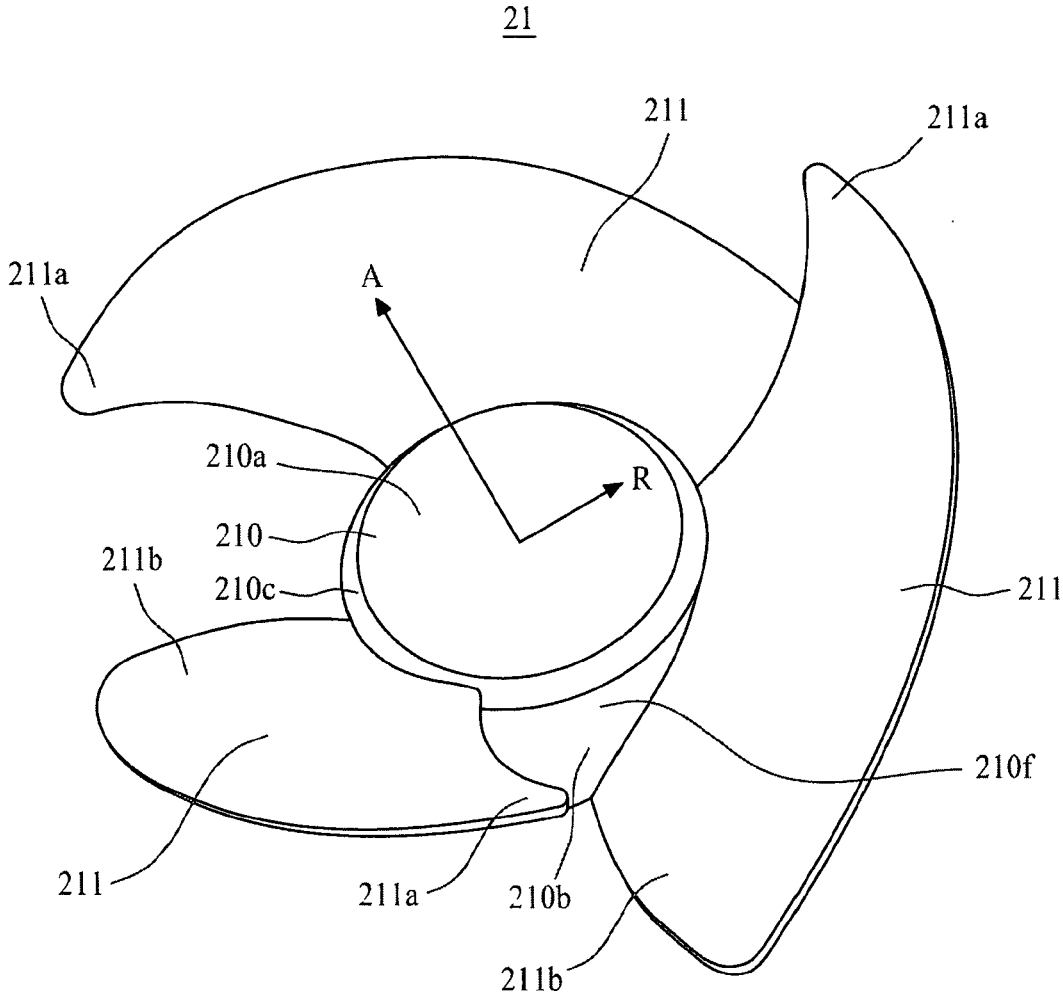
FIG. 3A is a perspective view of the impeller of the fan shown in FIG. 2A.
Figure 3B:
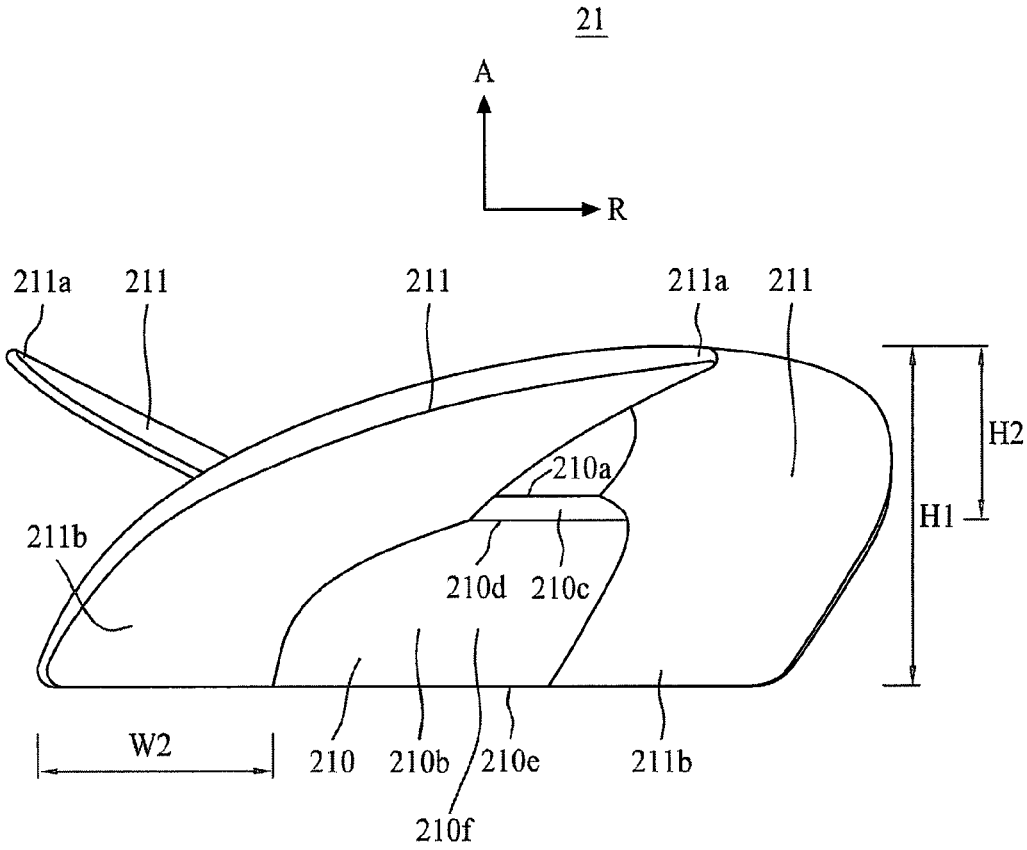
FIG. 3B is a side view of the impeller of the fan shown in FIG. 2A.

FIGS. 3A and 3B illustrate the perspective view and the side view of the impeller 21, respectively. The hub 210 has a central portion 210*a*, a side wall 210*b* annularly disposed around the central portion 210*a*, and a connection portion 210*c*. The side wall 210*b* has a top edge 210*d*, a bottom edge 210*e* opposite to the top edge 210*d* and an outer surface 210*f* between the top edge 210*d* and the bottom edge 210*e*. It should be noted that the connection portion 210*c* is rounded and connects the central portion 210*a* with the top edge 210*d* of the side wall 210*b*. Through the rounded design of the connection portion 210*c*, the air flow near the connection portion 210*c* is made smoother and the air intake area of the fan 2 is increased. A plurality of reinforcing ribs (not shown) is further disposed on the inner surface of the hub 210 to reinforce the strength of the impeller 21 so that the fan 2 can operate stably.

As shown in FIGS. 3A and 3B, a radial dimension W2 of each of the blades 211 in this invention is enlarged to increase the flow rate produced by each of the blades 211. Hence, the number of the blades 211 can be decreased. In this embodiment, the number of the blades 211 is three. Accordingly, during the operation of the fan 2, the disturbance of the air flows driven by the individual blades 211 to each other is minimized with reduced noise generation and improved heat dissipation efficiency.

In more detail, each of the blades 211 extends outwards along the radial direction R and the axial direction A from the outer surface 210*f* of the side wall 210*b* to form a tip 211*a* above the top edge 210*d* and a tail 211*b* extending at least along the radial direction R from the outer surface 210*f*. Each of the blades 211 is bent from the tip 211*a* towards the tail 211*b*. As shown in FIGS. 3A and 3B, each of the blades 211 of this invention is gradually broadened from the tip 211*a* to the tail 211*b* to increase the flow rate and air pressure of the fan 2. To mitigate the air flow disturbance between the blades 211 and the housing 22 in the radial direction R and the accompanying noise, both the tip 211*a* and the housing 211*b* are curved. In addition, each of the blades 211 has at least one portion of its periphery rounded to reduce the air disturbance around the blade 211, thereby further mitigating the noise generation. The rounded design makes the injection molding and demolding of the blades 211 and the hub 210 easier, and the production of the mold for producing the impeller 21 is also made easier because of the elimination of sharp corners. Consequently, the overall production cost is lowered and the production yield is increased.

In reference to FIG. 3B, each of the blades 211 has a radial dimension W2 and an axial dimension H1. The portion of each of the blades 211 extending beyond the top edge 210*d* along the axial direction A has a dimension H2 accounting for substantially between one third and two thirds of the axial length H1, which remarkably enlarges the area of the blade 211 for producing the air flow. Preferably, the dimension H2 of the portion extending beyond the top edge 210*d* accounts for substantially one half of the axial length H1. For example, if the axial length H1 of each of the blades 211 is substantially 3.6 cm, the dimension H2 of the portion extending beyond the top edge 210*d* is substantially 1.97 cm. Furthermore, the portion of each of the blades 211 extending beyond the top edge 210*d* along the axial direction A has an area larger than the area of the portion of the blade below the top edge 210*d*, so the air intake area of the fan 2 is increased and the portion of each of the blades 211 above the top edge 210*d* can suck in or discharge the air along the radial direction R without the interference from the hub 210, thus remarkably improving the air flow smoothness and enlarging the air intake/discharging area.

Each of the blades 211 can also extend beyond the bottom edge 210*e* along the axial direction A to enlarge the area of the blade 211 for producing the air flow. The portion extending beyond the bottom edge 210*e* can account for substantially between zero and one third of the axial dimension H1. In this embodiment, the portion of each of the blades 211 extending beyond the bottom edge 210*e* along the axial direction A accounts for substantially a zero percentage of the axial dimension H1.

In reference to FIG. 2B again, the tips 211*a* and the tails 211*b* of the fan 2 further extend upwards beyond the side wall 224*a* and downwards beyond the side wall 224*b* of the housing 22 along the axial direction A. This helps to prevent the housing 22 from disturbing the rotating blades 211 in producing the air flow so that the portion(s) of each of the blades 211 extending upwards or downwards beyond the housing 22 can suck in or discharge the air along the radial direction R, thus remarkably improving the air flow smoothness and enlarging the air intake/discharging area. However, those of ordinary skill in the art can design each of the blades 211 to extend only upwards beyond the side wall 224*a* or only downwards beyond the side wall 224*b* depending on practical needs, and no limitation is made herein.

Figure 4:
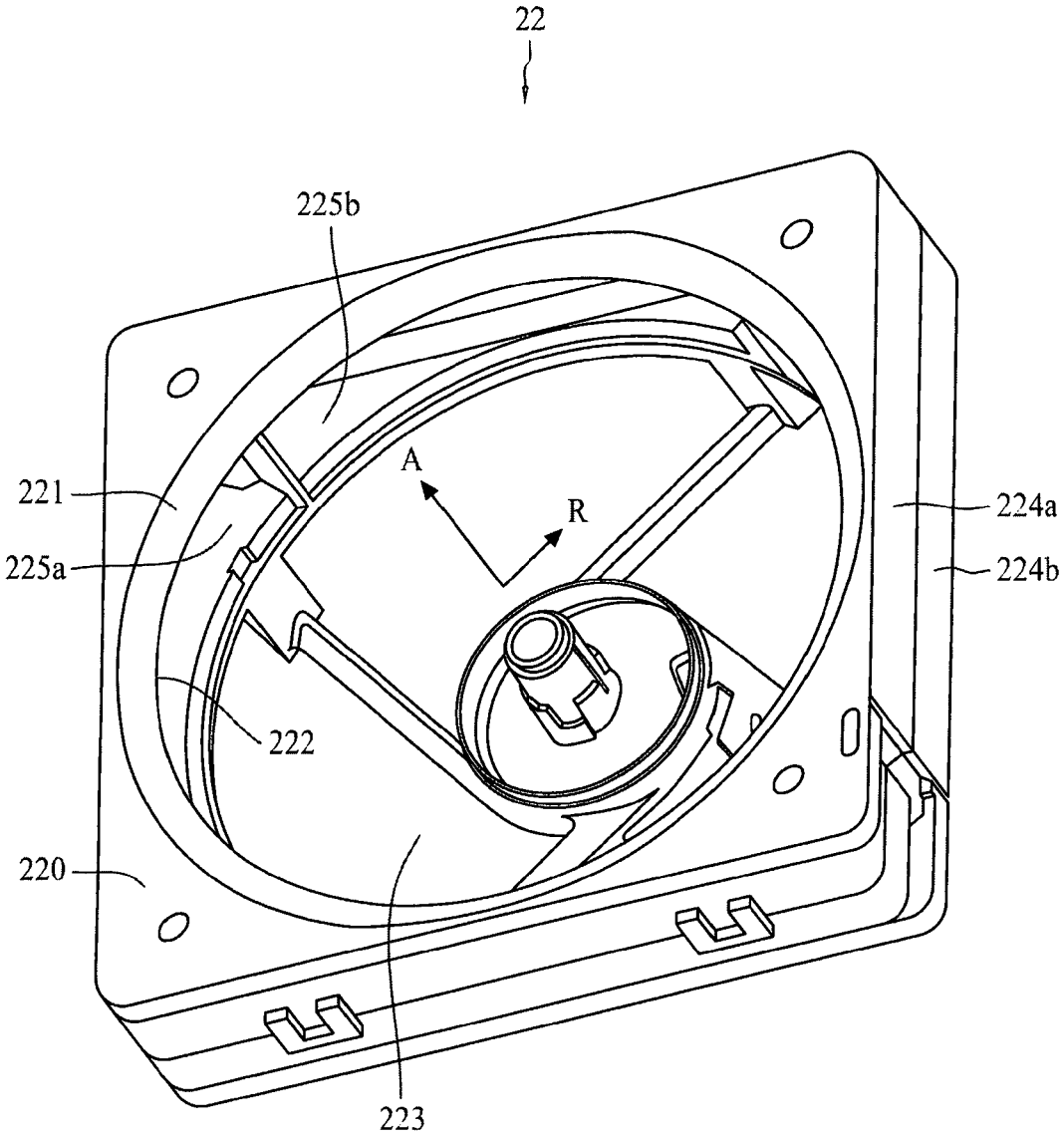
FIG. 4 is a perspective view of the housing of the fan shown in FIG. 2A.

FIG. 4 illustrates a detailed construction of the housing 22 of this invention. In this embodiment, the housing 22 is formed of a first frame and a second frame, wherein the housing 22 has a top surface 220, a flow conducting portion 221, a central hole 222, and a receiving space 223. The receiving space 223 of the housing 22 is adapted to receive the impeller 21, while the central hole 222 pneumatically connects the receiving space 223 with the ambience and exposes the impeller 21. Preferably, a clearance (not shown) should be tightened between the bottom of the impeller 21 and the housing 22 to provide the fan 2 with a water-proof function. The flow conducting portion 221 of the housing 22 is rounded to extend downwards from the top surface 220 to the central hole 222, which can improve the smoothness of the air flow sucked in or discharged from the housing 22, thereby reducing the noise and increasing the flow rate of the fan 2 during operation.

In reference to FIG. 4, the housing 22 further has a plurality of flow conducting grooves 225*a*, 225*b*. The flow conducting grooves 225*a*, 225*b* pneumatically communicate with the receiving space 223 to guide the air flow. This can inhibit the loss of the air flow at the housing 22 along the radial direction R when the blades 211 are rotating, thereby strengthening the air pressure and making the flow field within the fan smoother. It should be noted that although only two flow conducting grooves 225*a*, 225*b* are depicted in FIG. 4 as restricted by the viewing angle, this invention has no limitation on the number of flow conducting grooves 225*a*, 225*b*.

Figure 5:
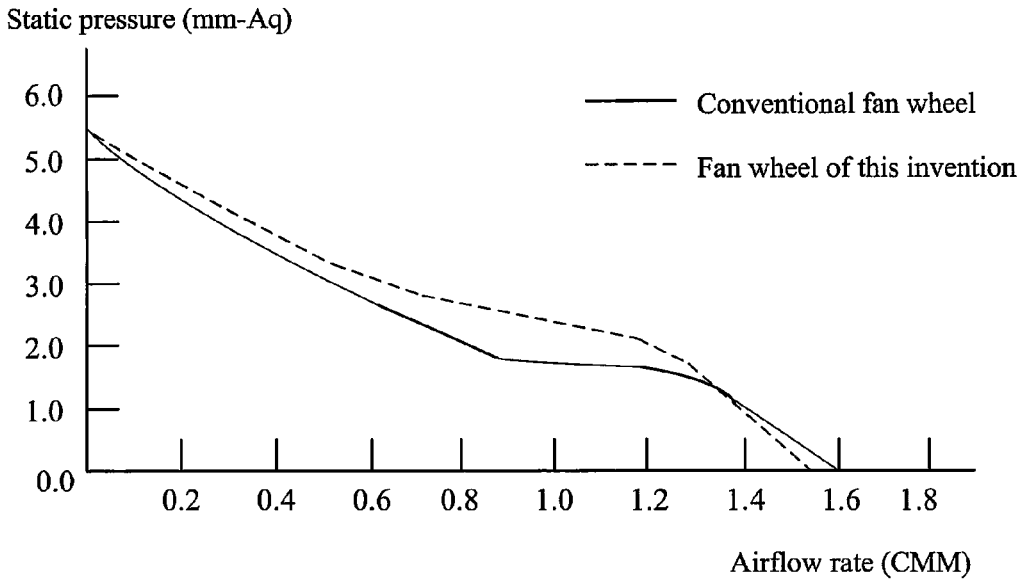
FIG. 5 is a graph showing the relation between the static pressure and airflow rate with respective to the conventional fan and the fan of the present invention shown in FIG. 2A and FIG. 2B.

FIG. 5 illustrates a graph of the performance of the fan 2 of this invention versus a conventional fan of a similar size. The horizontal axis represents the airflow rate in units of cubic meter per minute (CMM), while the vertical axis represents the static pressure in units of millimeter aqua (mm-Aq). In this embodiment, the impeller 21 has a radius of 4.6 cm, the hub 210 has a radius of 1.86 cm, each of the blades 211 has an axial dimension H1 of 3.6 cm and a radial dimension W2 of 2.74 cm, and the portion of each of the blades 211 extending beyond the top edge 210*d* of the hub 210 has a dimension of 1.97 cm. Furthermore, the housing 22 has a width of substantially 11.3 cm, the central hole 222 has a diameter of 10 cm, the flow conducting portion 221 has an outer diameter of 11.2 cm, the two frames 224*a*, 224*b* measure an overall height of 2.8 cm, and each of the blades 211 extends beyond the two frames 224*a*, 224*b* along the axial direction A by a total length of 0.67 cm. In FIG. 5, the performance curve of the fan 2 of this invention is denoted by a dashed line, while that of the conventional fan is denoted by a solid line. It can be seen from FIG. 5 that within an airflow rate range of 0.6 CMM to 1.2 CMM, the fan 2 of this invention delivers a significantly higher airflow rate than the conventional fan at the same static pressure. In addition, the fan 2 of this invention delivers a significantly higher static pressure than the conventional fan at the same airflow rate. Hence, as compared to the prior art, both the airflow rate and the air pressure produced by the fan 2 of this invention are positively improved.

Figure 6A:
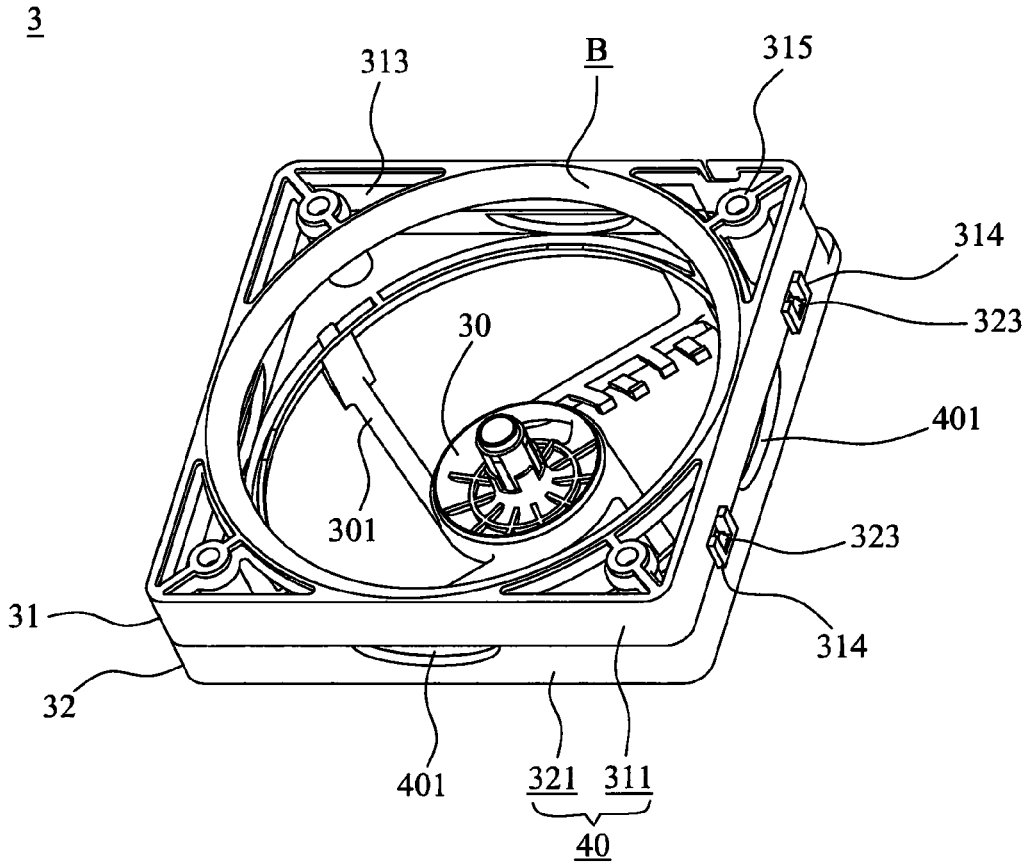
FIG. 6A is a perspective view of another type of housing of the fan according to the present invention.

With reference to FIG. 6A, the housing 3 according to another embodiment of the present invention is roughly square and includes a first frame 31, a second frame 32 and a motor base 30. The same impeller shown in FIG. 3A can also be received in the housing 3 to constitute a fan.

Figure 6B:
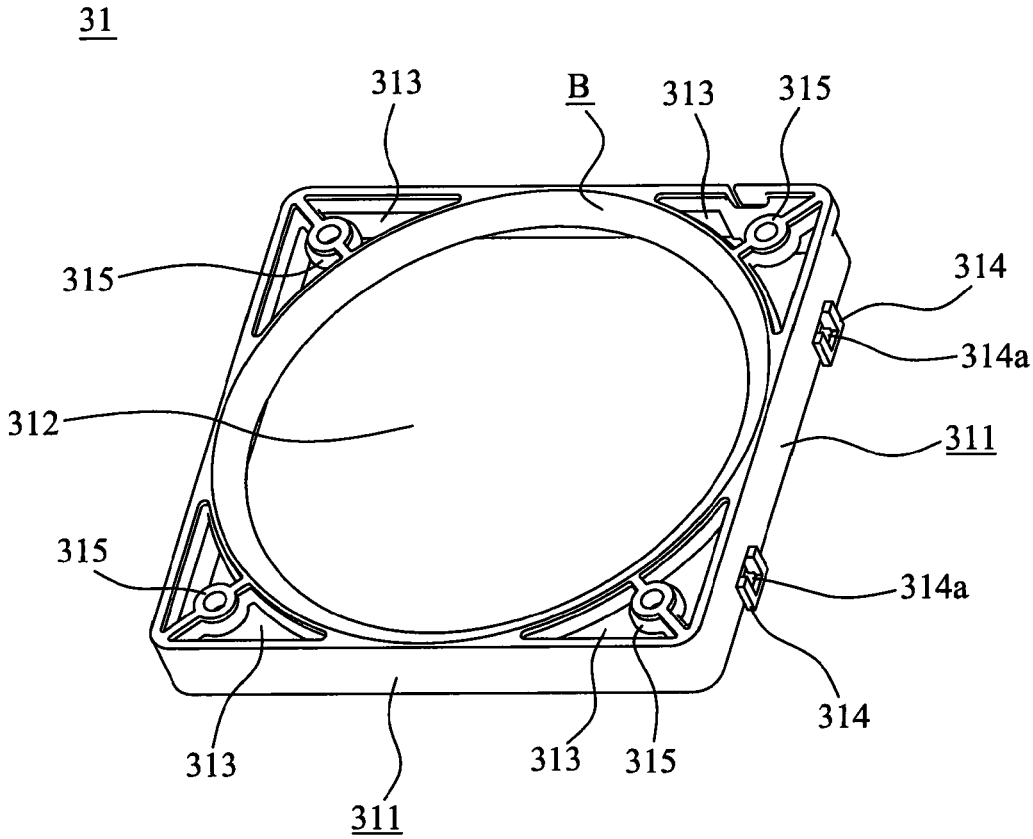
FIG. 6B is a perspective view of the first frame of the housing shown in FIG. 6A.

With reference to FIG. 6B, the first frame 31 has four side walls 311, and an inlet 312 is disposed at the center of the top surface of the first frame 31. An inner surface B disposed on the periphery of the inlet 312, is a smooth curved surface. Four hollow portions 313 are disposed at four corners of the top surface of the first frame 31, respectively.

Figure 6C:
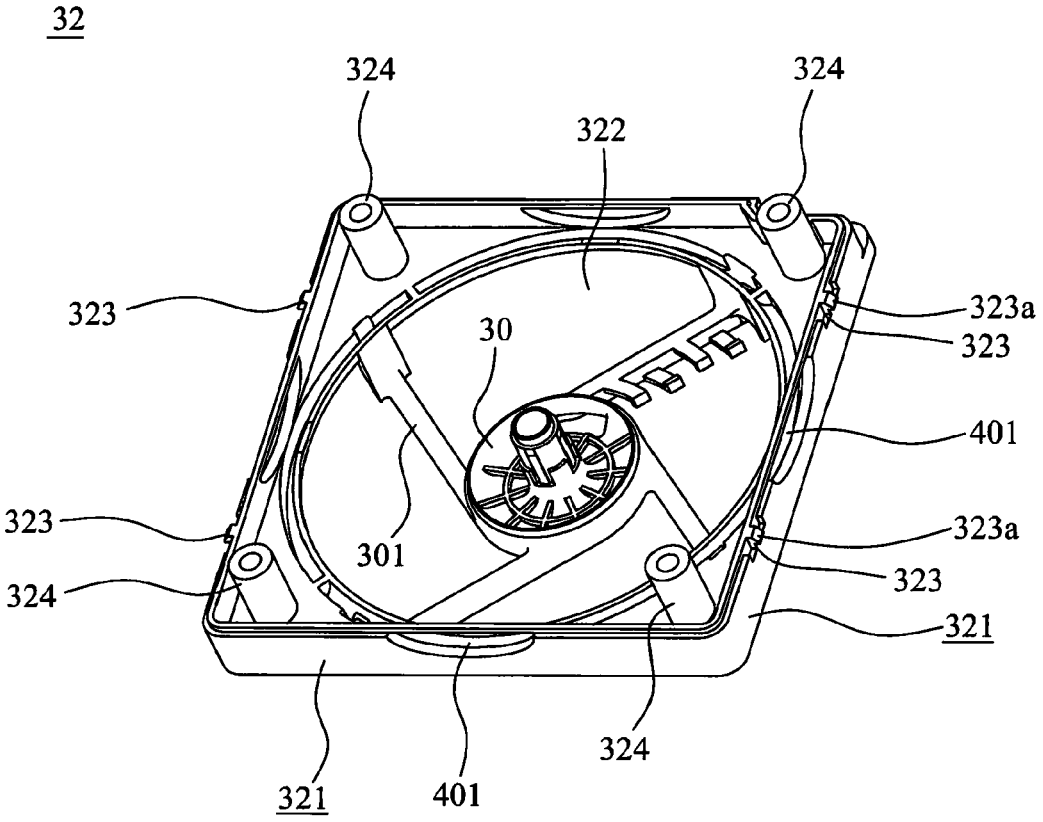
FIG. 6C is a perspective view of the second frame of the housing shown in FIG. 6A.

Referring to FIG. 6C, the second frame 32 has four side walls 321, and an outlet 322 is disposed at the center of the bottom surface of the second frame 32. The first frame 31 and the second frame 32 are connected with each other so that the four side walls 311 of the first frame 31 and the four side walls 321 of the second frame 32 construct four side walls 40 of the housing 3. In addition, four side holes 401 are disposed at four side walls 40 of the housing 3, respectively. In this embodiment, the side holes 401 are disposed at, for example but not limited to, the side walls 321 of the second frame 32, respectively. Alternatively, the side holes 401 can be disposed at the side walls 311 of the first frame 31, respectively. Otherwise, the side holes 401 can also be formed by combining four lower recesses disposed at the centers of top edges of the side walls 321 of the second frame 32 and four upper recesses disposed at the centers of bottom edges of the side walls 311 of the first frame 31, respectively.

The motor base 30 is disposed at the outlet 322 and connected to the second frame 32 through a plurality of ribs 301, and has a plurality of reinforcing bars within its inner side. In practice, the motor base 30 can be used to support a motor and an impeller. When the motor drives the impeller to rotate, the airflow enters the housing 3 through not only the inlet 312 but also the hollow portions 313 of the first frame 31 and the side holes 401 disposed at the side walls 321 of the second frame 32. Thus, the airflow rate of the fan can be increased and the heat-dissipating efficiency can be enhanced. Moreover, the insufficient airflow at the negative pressure side of the impeller can be compensated so that it is hard to form the vortex and turbulence at the negative pressure side, thereby improving the stall speed of the impeller. In addition, since the inner surface B is a smooth curved surface, the airflow can be smoothly guided into the housing 3 through the inlet 312. Furthermore, the noise wave and the performance of the fan can be kept when the impeller is in the stall speed.

In addition, the first frame 31 further has four first connecting members 314 and four first screw holes 315, and each first connecting member 314 has a hole 314*a*. Two of the first connecting members 314 are disposed at one side wall 311 of the first frame 31, and the other two first connecting members 314 are disposed at an opposite side wall 311 of the first frame 31. This is for example but not limited to this embodiment; for example, the four first connecting members 314 can be disposed at four side walls 311 of the first frame 31, respectively.

Similarly, the second frame 32 further has four second connecting members 323 and four second screw holes 324, and each second connecting member 323 has a hook 323*a* extended upwardly. The second connecting members 323 are disposed at the side walls 321 of the second frame 32 corresponding to the first connecting members 314 so that the hooks 323*a* of the second connecting members 323 can be engaged with the holes 314*a* of the first connecting members 314, thereby firmly combining the first frame 31 and the second frame 32. The first screw holes 315 are disposed in the hollow portions 313 of the first frame 31, respectively, the second screw holes 324 are disposed between the periphery of the outlet 322 and the four corners of the second frame 32, respectively. The first screw holes 315 and the second screw holes 324 are disposed corresponding to each other, so that four screws (not shown) can pass through the corresponding first and second screw holes 315 and 324, respectively, thereby further closely combining the first frame 31 and the second frame 32.

Figure 7:
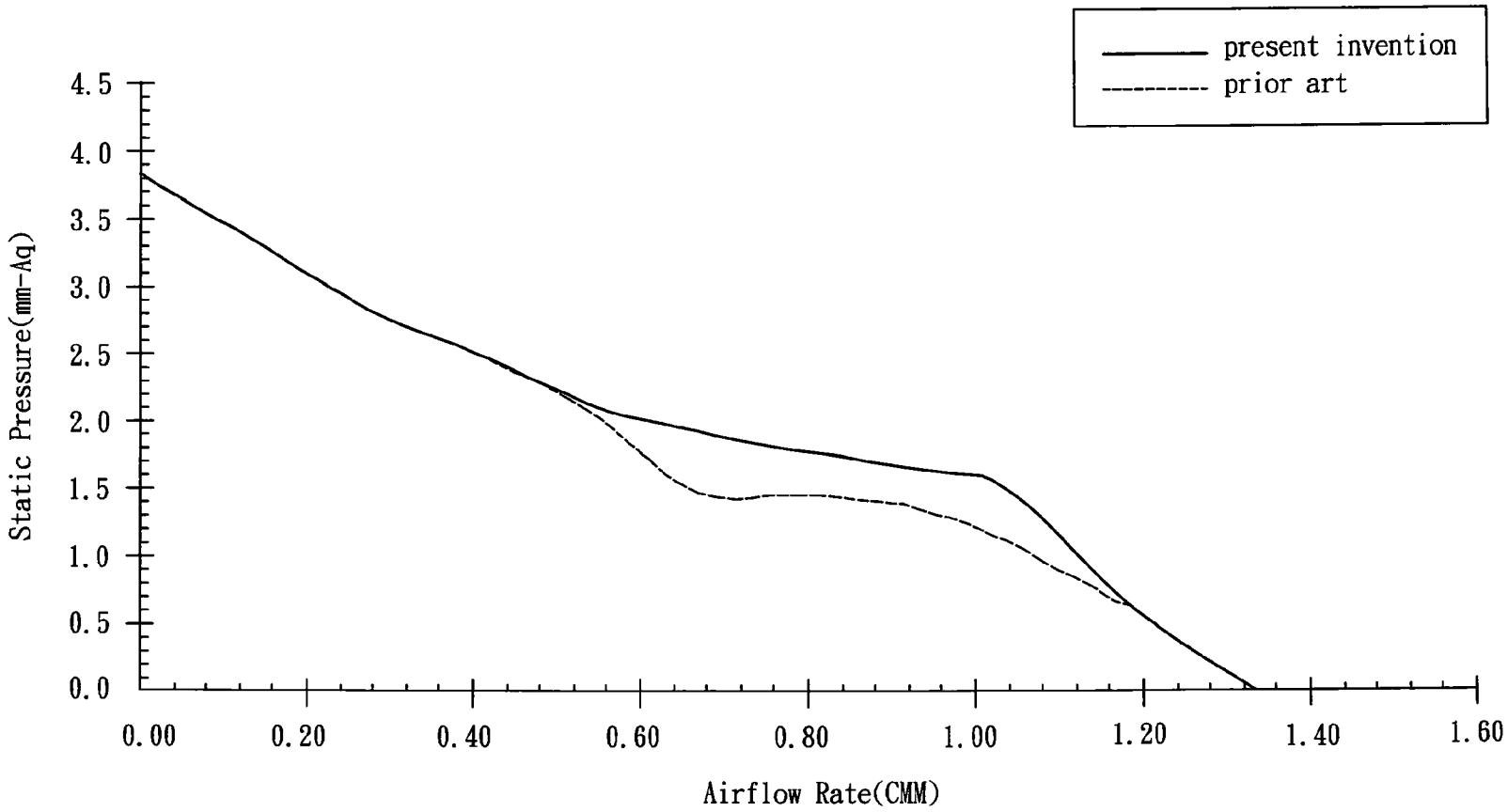
FIG. 7 is a graph showing the relation between the static pressure and airflow rate with respective to the conventional fan and the fan with the housing shown in FIG. 6A.

FIG. 7 shows an experimental result with static pressure vs. airflow rate (P&Q) curves, which represent the relations between the static pressure and the airflow rate in the fan with the conventional fan frame and the fan with the housing shown in FIG. 6A. The dotted line represents the P&Q curve of the fan with the conventional fan frame, and the solid line represents the P&Q curve of the fan with the housing shown in FIG. 6A. Regarding to the middle portions of the dotted and solid lines, the dotted line is lower than the solid line. This means that the fan with the conventional fan frame has lower static pressure and airflow rate in the stall speed than that of the fan with the fan frame 1 of the present invention. In other words, the static pressure and airflow rate of the fan of the present invention in the stall speed are much better than the prior art.

In summary, the present invention provides a fan capable of increasing the airflow volume and rate, reducing the noise and increasing heat-dissipating efficiency. The present invention also provides a fan with the hollow portions and the side holes to increase the air intake so that the air intake and discharge as well as the heat-dissipating efficiency can be increased. Furthermore, the insufficient airflow at the negative pressure side of the impeller can be compensated, so that it is hard to form the vortex and turbulence at the negative pressure side, thereby improving the stall speed of the impeller. In addition, since the inner surface is a smooth curved surface, the airflow can be smoothly guided into the housing. Thus, the noise wave and the performance of the fan can be kept when the impeller is in the stall speed.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A fan comprising:

an impeller comprising a hub and a plurality of blades, wherein each of the blades has a tip and a tail, wherein one of the blades is bent from the tip toward the tail and gradually broadened from the tip to the tail; and a housing for receiving the impeller, wherein the housing comprises a first frame and a second frame, and a motor base, wherein the first frame has a side wall, and an inlet disposed at the center of the first frame, and the second frame comprises a side wall and an outlet disposed at the center of the second frame, wherein the first or second frame comprises at least one side hole disposed at the side wall, respectively.

2. The fan as claimed in claim 1, wherein a portion of each of the blades extending beyond a bottom of the hub along an axial direction of the hub has a dimension ranged between zero and one third of the axial length of the hub.

3. The fan as claimed in claim 1, wherein a portion of each of the blades extends beyond a top of the hub along an axial direction of the hub has a dimension ranged between one third and two thirds of an axial length of the hub.

4. The fan as claimed in claim 1, wherein the portion of each of the blades extending beyond a top of the hub along an axial direction of the hub is larger than the portion of the blade below the top of the hub.

5. The fan as claimed in claim 1, wherein the hub has a central portion, a side wall disposed around the central portion, and a connection portion, wherein the connection portion is rounded and connects the central portion with the side wall.

6. The fan as claimed in claim 1, wherein the tips of the blades are curved, and each of the blades has at least one portion of its periphery rounded to reduce the air disturbance around the blades.

7. The fan as claimed in claim 1, wherein the tips of the blades extend upwards beyond a top surface of the housing or the tails of the blades downwards beyond a bottom surface of the housing along the axial direction of the fan.

8. The fan as claimed in claim 1, wherein the housing has a top surface, a flow conducting portion, a central hole, and a receiving space, wherein the flow conducting portion of the housing is rounded to extend downwards from the top surface to the central hole.

9. The fan as claimed in claim 1, wherein the housing further comprises a plurality of flow conducting grooves pneumatically communicating with the receiving space to guide the air flow.

10. The fan as claimed in claim 1, wherein the first frame further comprises hollow portions disposed at corners of the first frame, respectively.

11. The fan as claimed in claim 10, wherein the first frame further comprises at least one first connecting member and at least one first screw hole, and the second frame further comprises at least one second connecting member and at least one second screw hole, wherein the second connecting member has a hook to be engaged with a hole of the first connecting member when the first frame and the second frame are assembled together.

12. A fan comprising:

an impeller comprising a hub and a plurality of blades; and a housing receiving the impeller and comprising a first frame having a side wall and an inlet, and a second frame having a side wall and an outlet, wherein an inner surface on a periphery of the inlet is a smooth curved surface, wherein the first or second frame has at least one side hole disposed at the side wall of the first or second frame.

13. The fan as claimed in claim 12, wherein the first frame comprises at least one hollow portion disposed at one corner of the first frame.

14. The fan according to claim 13, wherein the first frame has at least one first screw hole, the second frame has at least one second screw hole corresponding to the first screw hole, and a screw passes through the first screw hole and the second screw hole to closely combine the first frame and the second frame, wherein the first screw hole is disposed in the hollow portion of the first frame, and the second screw hole is disposed at a corner of the second frame.

15. The fan according to claim 12, wherein the first frame comprises a first recess disposed at the center of a bottom edge of the side wall of the first frame, the second frame comprises a second recess disposed at the center of a top edge of the side wall of the second frame, and a side hole is formed by combining the first recess and the second recess.

16. The fan according to claim 12, wherein the first frame has at least one first connecting member, the second frame has at least one second connecting member, and the first connecting member and the second connecting member are engaged with each other.

17. The fan according to claim 12, wherein the housing further comprises a motor base disposed at the outlet, connected to the second frame through a plurality of ribs.

* * * * *